US008336678B2

(12) United States Patent
Poutiainen et al.

(10) Patent No.: US 8,336,678 B2
(45) Date of Patent: Dec. 25, 2012

(54) TOUCH BASED ELEVATOR CALL PANEL

(75) Inventors: Vesa Poutiainen, Helsinki (FI); Niko Rusanen, Helsinki (FI)

(73) Assignee: Kone Corporation, Helskinki (FI)

( * ) Notice: Subject to any disclaimer, the term of this patent is extended or adjusted under 35 U.S.C. 154(b) by 0 days.

(21) Appl. No.: 13/179,740

(22) Filed: Jul. 11, 2011

(65) Prior Publication Data

US 2012/0024638 A1 Feb. 2, 2012

Related U.S. Application Data

(63) Continuation of application No. PCT/FI2010/000012, filed on Feb. 16, 2010.

(51) Int. Cl.
*B66B 1/34* (2006.01)

(52) U.S. Cl. ..... 187/395; 187/396

(58) Field of Classification Search ..... 187/247, 187/391–396

See application file for complete search history.

(56) References Cited

U.S. PATENT DOCUMENTS

| | | | | |
|---|---|---|---|---|
| 5,679,934 | A * | 10/1997 | Juntunen et al. | 187/395 |
| 6,161,654 | A * | 12/2000 | Sirigu et al. | 187/391 |
| 6,502,668 | B1 * | 1/2003 | Chida et al. | 187/395 |
| 6,550,587 | B1 * | 4/2003 | Yuasa et al. | 187/394 |
| 6,615,175 | B1 | 9/2003 | Gazdzinski | |
| 7,281,610 | B2 * | 10/2007 | Ylinen et al. | 187/382 |
| 7,398,865 | B2 * | 7/2008 | Felder et al. | 187/395 |
| 7,404,469 | B2 * | 7/2008 | Takeuchi | 187/391 |
| 7,404,470 | B2 * | 7/2008 | Felder et al. | 187/395 |
| 7,404,471 | B2 * | 7/2008 | Felder et al. | 187/395 |
| 7,711,565 | B1 * | 5/2010 | Gazdzinski | 704/270 |
| 7,958,971 | B2 * | 6/2011 | Mangini et al. | 187/396 |
| 8,065,156 | B2 * | 11/2011 | Gazdzinski | 704/275 |
| 2001/0035314 | A1 * | 11/2001 | Yoshida et al. | 187/382 |
| 2004/0262093 | A1 * | 12/2004 | Forsythe et al. | 187/391 |
| 2005/0252723 | A1 | 11/2005 | Takeuchi | |
| 2009/0294221 | A1 * | 12/2009 | Bahjat et al. | 187/396 |
| 2012/0097488 | A1 * | 4/2012 | Taiana | 187/395 |

FOREIGN PATENT DOCUMENTS

| | | | |
|---|---|---|---|
| EP | 1386875 | A1 | 2/2004 |
| JP | 2003-95547 | A | 4/2003 |
| JP | 2004-115151 | A | 4/2004 |
| JP | 2005-162465 | A | 6/2005 |
| WO | WO 2006/011876 | A1 | 2/2006 |
| WO | WO 2007/046807 | A1 | 4/2007 |

* cited by examiner

*Primary Examiner* — Anthony Salata

(74) *Attorney, Agent, or Firm* — Birch, Stewart, Kolasch & Birch, LLP

(57) ABSTRACT

The present invention presents a call panel of an elevator or of an elevator system including one or more display elements, a front plate covering the call panel, in connection with which front plate a touch sensor is fitted, and also a control unit to which the display elements and also the touch sensor are connected. The detection area of the touch sensor covers both an active area, and a passive area, where the active area additionally utilizes display elements, while the passive area lacks display capability and remains outside at least some of the aforementioned active area, in which one or more touch-sensitive pushbuttons are disposed in the passive area. The control unit is arranged to react to a touch of the touch-sensitive pushbuttons specified for the aforementioned detection area.

17 Claims, 6 Drawing Sheets

TOUCH BASED ELEVATOR CALL PANEL

CROSS-REFERENCE TO RELATED APPLICATIONS

Figure 1:
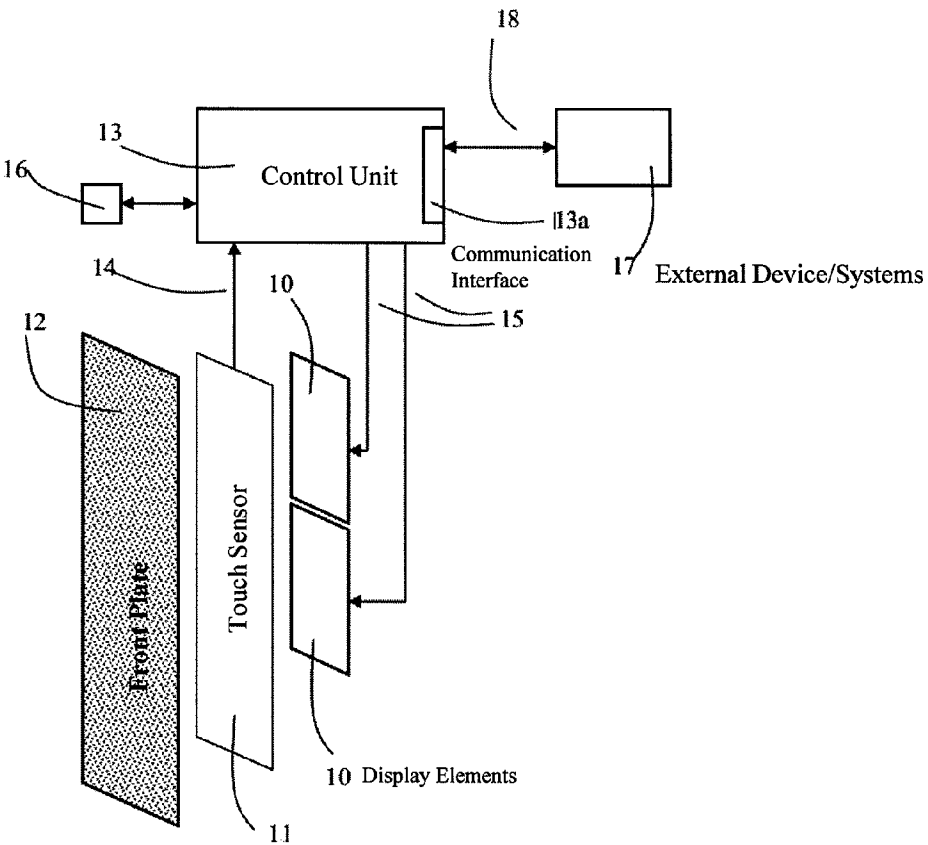

This application is a Bypass Continuation of PCT International Application No. PCT/FI2010/000012 filed on Feb. 16, 2010, which claims priority under 35 U.S.C. 119 (a) to Patent application No. 20090054 filed in Finland, on Feb. 16, 2009. The entire contents of all of the above applications is hereby incorporated by reference.

FIELD OF THE INVENTION

The invention relates to elevator systems. More particularly the invention relates to elevator system call panels that are implemented with touch-sensitive pushbuttons.

BACKGROUND OF THE INVENTION

Elevator systems normally comprise call-giving appliances both on the floor levels and in the elevator cars, with which appliances calls are given for receiving an elevator car at the call floor and for sending the elevator car to the desired destination floor. So-called destination call systems are also known in the art, in which systems the passenger expresses his/her destination floor already at the departure level, in which case the elevator cars do not necessarily need to comprise call-giving appliances for giving calls. For various reasons many call appliance solutions that are different both visually and in their layout are used both on floor levels and in elevator cars, which solutions e.g. contain a different number of call pushbuttons. The aforementioned call-giving appliances normally comprise pressure switches or touch-sensitive switches, which are disposed in the call panel on the wall of the floor level or of the elevator car. Call panels can also comprise display units, with which information connected to the elevator journey is given to the elevator passengers.

Touch-sensitive displays and other corresponding apparatuses based on touch-sensitive pushbuttons are becoming increasingly more widespread owing to the benefits that they offer. One problem with touch-sensitive displays is, however, that the display elements are manufactured according to certain standard dimensions, in which case implementation of call panels of the desired shape and size is awkward. Especially in cases in which it is desired to dispose a call panel in the elevator car, e.g. on the wall on the side of the door opening of the elevator car, an essentially narrow call panel elongated in the vertical direction is necessary so that it could be disposed in the aforementioned position in the elevator car. A corresponding space problem can arise if it is desired to dispose a call panel on a floor level in the space between adjacent elevator doors. Since the display elements of touch-sensitive displays that are manufactured as mass products are generally 4:3 or 16:9 in aspect ratio, they are not at all suited as such for use in a call panel of elevators within the scope of the set layout requirements. One possible method to solve the aforementioned problem is to dispose a number of touch-sensitive displays in a call panel, in which case integration of the needed functions into an elongated, essentially narrow call panel is possible. The solution, however, easily becomes complex and expensive, because each display element comprises, in addition to the display element itself, also a touch sensor connected to the display element and the control electronics required by it. Furthermore, conventional touch-sensitive displays cannot be protected from environmental impacts nor from vandalism, which easily results in different malfunctions in elevator operation. Since the touch-sensitive surface in conventional touch-sensitive displays covers only the area covered by the display element, the area outside the display elements remains unutilized from the call panel. All in all, conventional touch-sensitive displays set considerable limitations, in relation to layout as well as in relation to appearance, for the design of call panels applicable to elevator use.

AIM OF THE INVENTION

The aim of the present invention is to eliminate or at least to alleviate the aforementioned drawbacks that occur in call panel solutions known in the art. The aim of the invention is also to achieve one or more of the following objectives:

- a cost-effective call panel suited for elevator use that can be implemented using cheap display elements manufactured as mass products,
- a call panel in which the desired layout can be implemented using display elements of standard sizes,
- a call panel based on touch-sensitive pushbuttons, in which the whole front surface of the call panel can be utilized for the functions of the call panel,
- to improve the fault tolerance of a call panel and at the same time the utilization rate of an elevator system,
- an essentially universal call panel that can be easily varied for different usage sites,
- a call panel that is easy to clean and is tidy in appearance,
- a call panel based on touch-sensitive pushbuttons, which is also suited for use by visually impaired people.

SUMMARY OF THE INVENTION

The present invention presents a call panel of an elevator or of an elevator system. The call panel comprises one or more display elements, a front plate that covers the call panel, in connection with which front plate a touch sensor is fitted, and also a control unit of the call panel, to which the aforementioned display elements and the aforementioned touch sensor are connected. According to the invention, of the front surface of the front panel, the detection area of the touch sensor covers both an active area, and a passive area, where the active area additionally utilizes display elements, while the passive area lacks display capability and remains outside at least some of the aforementioned active areas, in which one or more touch-sensitive pushbuttons are disposed in the passive area, and a control unit is arranged to react to a touch of the touch-sensitive pushbuttons specified for the aforementioned detection area. The term "active area" refers in this context to the area covered by the front plate, in which the desired graphics can be presented to elevator passengers by means of a display element, and correspondingly the term "passive area" refers to the rest of the area covered by the front plate, which does not belong to the aforementioned active area. The touch-sensitive pushbuttons that are specified for the call panel can be situated in the active area and/or in the passive area, however so that they are situated in the detection area of a touch sensor. In one embodiment of the invention one or more standard pushbuttons of the elevator or of the elevator system are disposed in a passive area, which standard pushbutton is needed in a number of applications of a call panel, e.g. a door-open pushbutton, a door-close pushbutton, an alarm pushbutton, a VIP call pushbutton. The touch sensor is e.g. a film-type touch sensor fixed to the rear surface of the front plate.

The control unit can be connected to the elevator or elevator system to be controlled, or to another system external to the control unit, via an interface for conveying control commands, status information and/or other information between the control unit and the external systems.

In one embodiment of the invention the construction of the call panel is essentially universal such that e.g. the number of display elements can vary without changing the construction of the call panel. The call panel can comprise two or more display elements, which are installed in a vertical attitude in the call panel so that the shorter sides of the display elements are in an essentially horizontal direction and essentially face to face with respect to each other.

In one embodiment of the invention the front panel is partly translucent so that it allows light produced by the display elements through but covers from view the features of the display elements and of other actuators and structures that are behind the front panel.

In one embodiment of the invention at least one embossed pushbutton is arranged for visually impaired people on the front surface of the front plate in connection with a touch-sensitive pushbutton. An embossed pushbutton can be e.g. a pushbutton sticker, which is glued to the front surface of the front plate or embossing produced on the front surface of the front plate by machining. Embossing comprises e.g. Braille (Braille characters), which indicates to a visually impaired person the function connected to an embossed pushbutton. A touch-sensitive pushbutton connected to an embossed pushbutton can cover the area covered by the embossed pushbutton and/or the area immediately beside it. In one embodiment of the invention a group comprising a number of embossed pushbuttons is made from a standard tape-type sticker (a standard preform), from which the section according to the installation site is cut off, e.g. on the basis of the floors/floor numbers served by an elevator, and it is glued onto the front surface of the call panel.

In one embodiment of the invention the control unit is fitted to change its operating mode on the basis of fault data connected to the call panel. Fault data in this context refers to information that indicates failure of some component of the call panel, e.g. failure of a display element. On the basis of the fault data the control unit changes its operating mode so that the failed component does not prevent use of the elevator or of the elevator system. The fault data can be fault data generated by the control unit itself or it can be information received by the control unit, which is conveyed to the control unit e.g. from a remote service center or entered locally directly into the control unit.

With the call panel according to the invention numerous advantages are achieved compared to prior-art solutions. The call panel according to the invention is advantageous to manufacture because essentially cheap display elements that are already in mass production can be used to achieve the desired layout, i.e. form. Cost savings can also be achieved because the display elements do not need to comprise pre-integrated touch sensors because in the solution according to the invention only one touch sensor that covers essentially the front surface of the call panel is used, regardless of the amount of display elements. The construction of the call panel is universal, in which case the needs of the installation site can be taken into account better in the different deliveries and at the same time savings can be achieved in the manufacturing costs of the call panel. In the solution according to the invention the whole front surface of the call panel can also be effectively utilized by covering the active areas and the passive areas with the same touch sensor and by specifying touch-sensitive pushbuttons for both areas. By covering the whole front surface of a call panel with a continuous front plate, the components inside the call panel can be protected from detrimental environmental impacts, such as e.g. dust, and at the same time malfunctions resulting from vandalism can be prevented or at least reduced. A continuous front plate is also easy to clean and to keep tidy. By making the front panel semitranslucent, behind which the components and other structures of the call panel can be hidden from view, the construction can be made to be simple and neat. As a result of the invention, the fault tolerance of a call panel can be improved by changing the functions of the call panel in fault situations so that at least the basic functions of the call panel can be used by passengers also in different fault situations. In the solution according to the invention a passive area can be advantageously utilized by disposing fixed embossed pushbuttons in the passive area, in which case the active areas remain for the use of dynamically formable touch-sensitive pushbuttons.

LIST OF FIGURES

Figure 2:
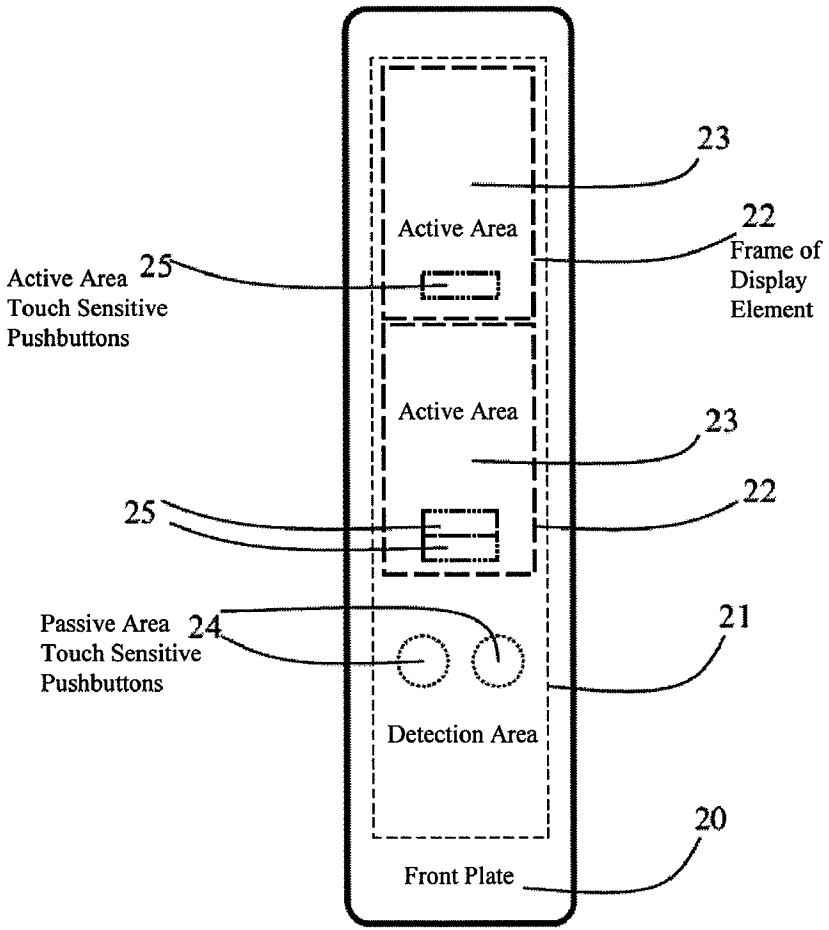
Figure 3A:
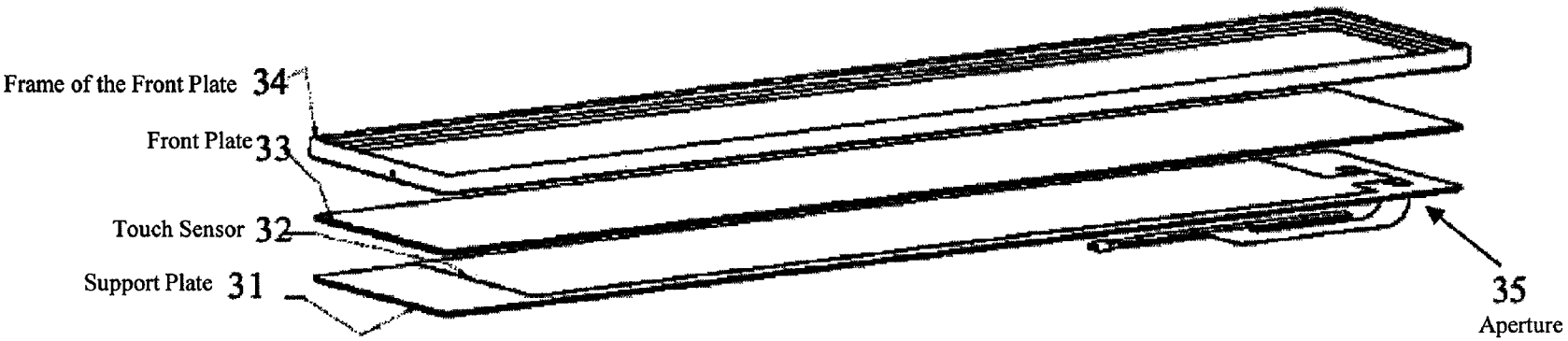
Figure 3B:
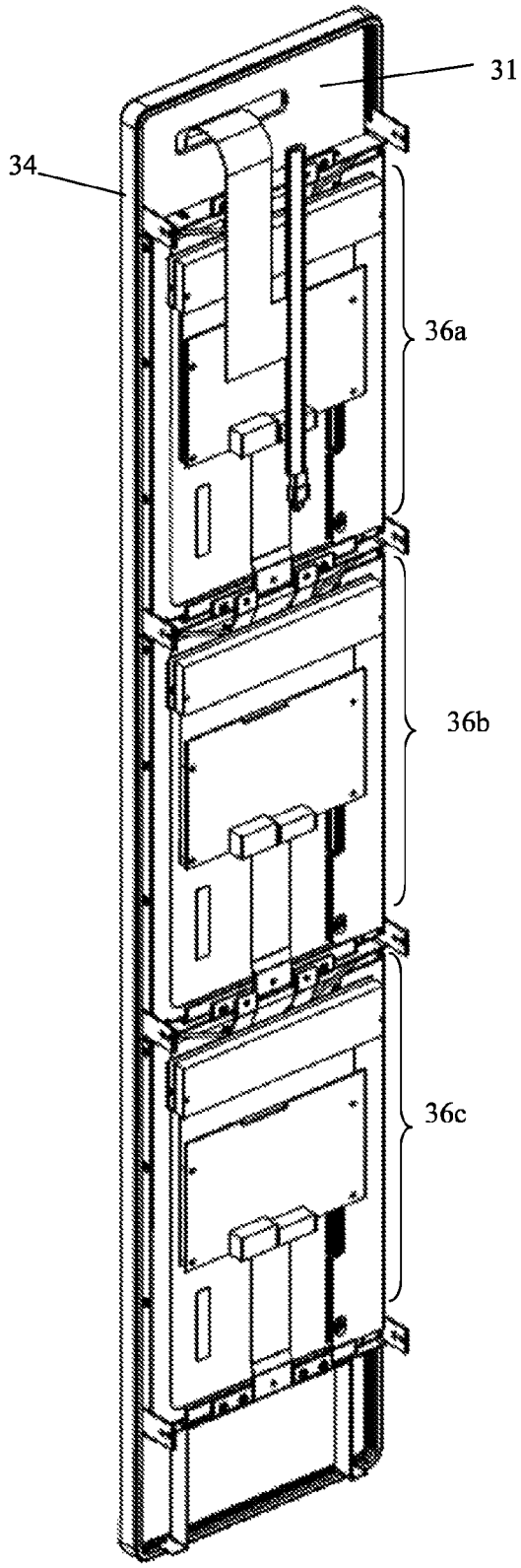
Figure 4:
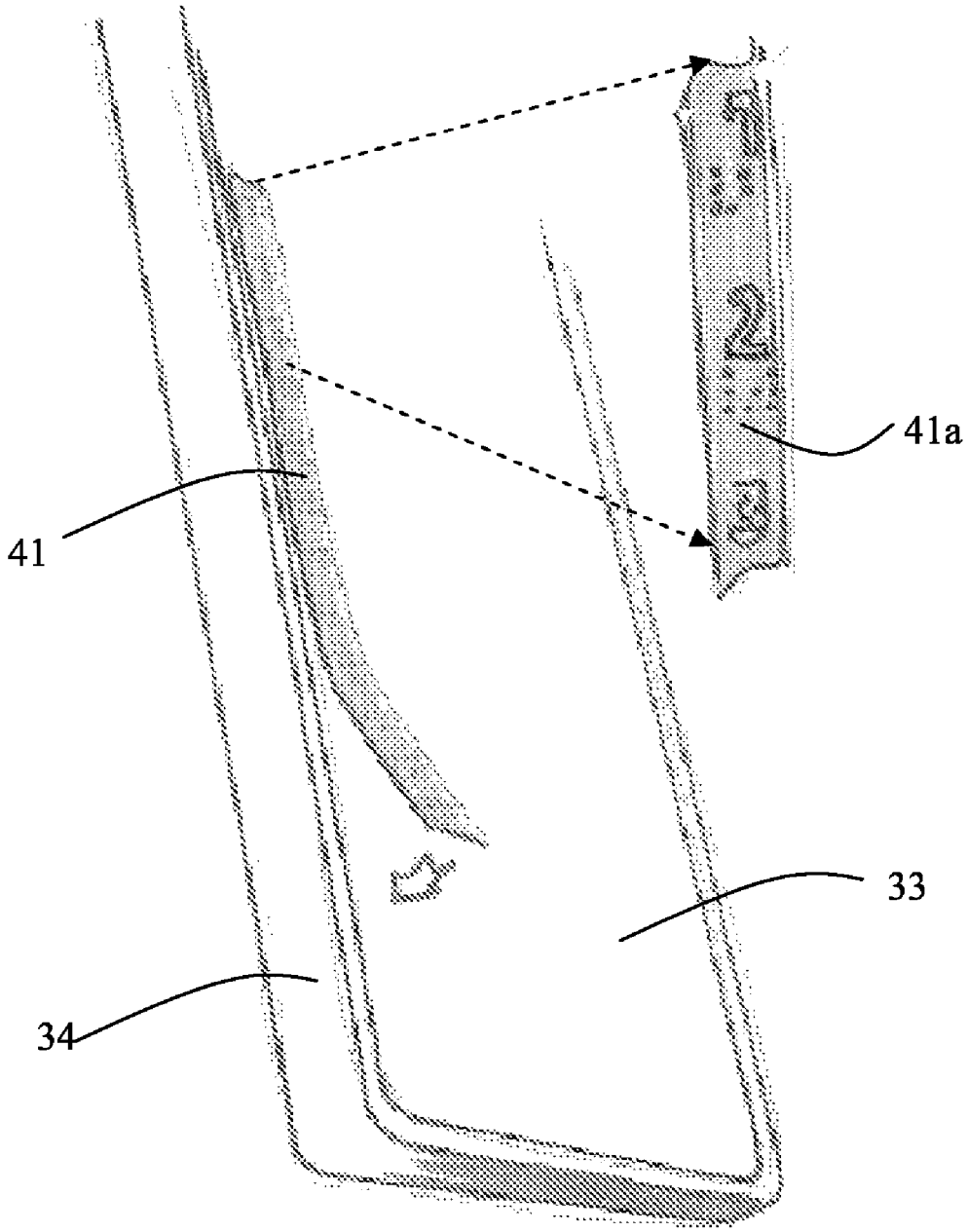
Figure 5:
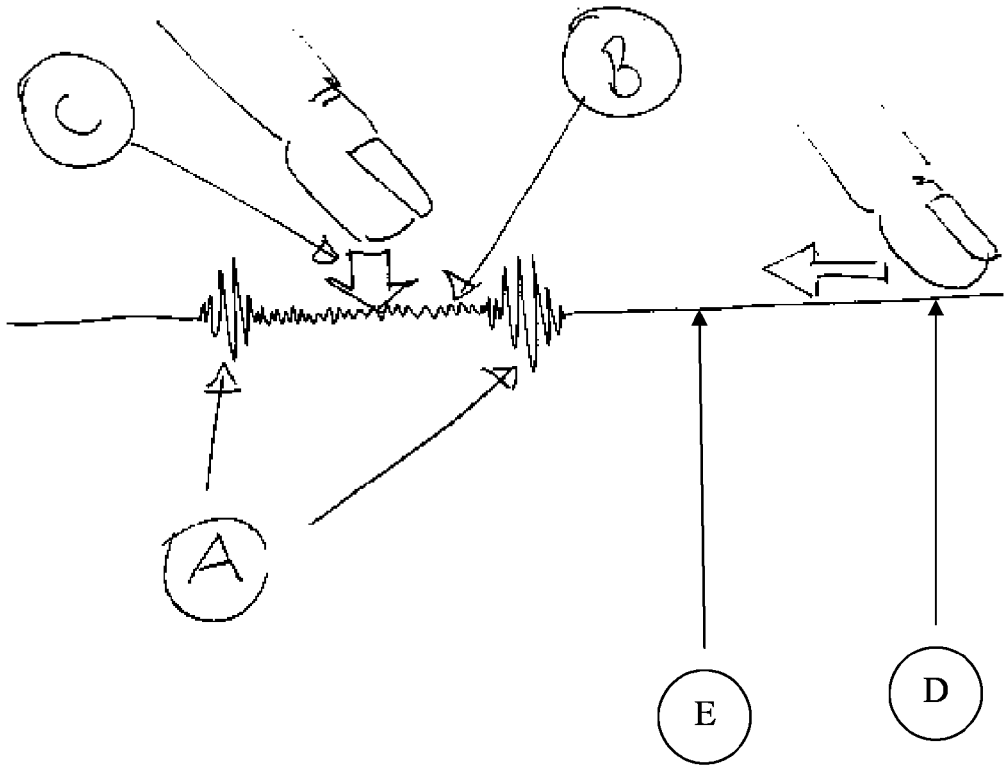

In the following, the invention will be described in detail by the aid of a few examples of its embodiments, wherein:

FIG. 1 presents the basic components of a call panel according to the invention, FIG. 2 presents a front view of one call panel according to the invention, FIGS. 3*a* and 3*b* present the assembly of a call panel according to the invention, FIG. 4 presents the joining of an embossed tape to a call panel according to the invention, and FIG. 5 presents a schematic drawing of a proximity signal of a touch.

DETAILED DESCRIPTION OF THE INVENTION

FIG. 1 presents the basic components of a call panel according to the invention, which are: display elements 10, a touch sensor 11, a front plate 12, and also a control unit 13. FIG. 1 contains two display elements 10, but the number of them can also be different, depending on the installation site. The display elements are installed in a vertical attitude such that their shorter sides are horizontal, in which case the aspect ratio will be e.g. 3:4 or 9:16. The display elements are installed with their shorter sides facing each other to achieve an elongated lay-out. The display elements are e.g. flat TFT displays (TFT-LCD). The front surface of the front plate 12 forms the front surface of the call panel, in connection with which front surface a touch sensor 11 is integrated so that the detection area covers essentially the whole front surface of the front plate. The front panel is partly translucent so that the graphic information produced with the display elements is visible to elevator passengers but all the other components, apertures and other features behind the front plate are hidden from view. Thus, for example, the display elements 10, which are installed one above the other in the vertical direction, form from the viewer's standpoint an essentially uniform display because the semitranslucent front plate dispels from view the frames surrounding the display elements. The aforementioned semitranslucent effect can be achieved e.g. by manufacturing the front plate from a darkened material and/or by disposing a colored film behind the front plate, which allows a suitable ratio of light to pass through. The aforementioned semitranslucent film can also be printed onto the rear surface of the front plate or implemented with a film, the degree of darkening of which is controlled e.g. on the basis of the intensity of the ambient light of the call panel.

The touch sensor 12 is e.g. a film-type touch sensor based on capacitive detection, which can be manufactured to the desired shape and fixed to the rear surface of the front plate e.g. by gluing or by disposing it between the front plate and the support plate as is presented in FIG. 3.

The control unit 13 comprises a processor and also a memory medium connected to the processor, in which memory medium the software needed in the control of the call panel is stored. The control unit 13 is connected to the display elements 10 by means of a signal bus 14 for presenting the desired graphical information with the display elements. The information comprises e.g. static background images, status data of the elevator such as the floor number at which the elevator is or at which the elevator will next stop, guidance information, advertisements, news, building-specific information, etc. The touch-sensitive pushbuttons connected to each operating mode of the call panel, comprising information about the location of each touch-sensitive pushbutton and about the size of the touch sensor in the detection area, are specified in the control unit. Dynamic touch-sensitive pushbuttons can be specified for the active areas of the display elements, which active areas can be used by elevator passengers only in a certain operating mode, whereas the position of the touch-sensitive pushbuttons specified for the passive areas is fixed. The control unit performs the necessary conversions of the coordinates between the active areas and the detection area of the touch sensor for fitting the touch-sensitive pushbuttons and the place of the graphical patterns presenting them to each other.

The touch sensor 11 is e.g. a film-type touch sensor based on capacitive detection, which can be manufactured to the desired shape and fixed to the rear surface of the front plate e.g. by gluing or by disposing it between the front plate and the support plate as is presented in FIG. 3.

The control unit 13 comprises a processor and also a memory medium connected to the processor, in which memory medium the software needed in the control of the call panel is stored. The control unit 13 is connected to the display elements 10 by means of a signal bus 15 for presenting the desired graphical information with the display elements. The information comprises e.g. static background images, status data of the elevator such as the floor number at which the elevator is or at which the elevator will next stop, guidance information, advertisements, news, building-specific 15 information, etc. The touch-sensitive pushbuttons connected to each operating mode of the call panel, comprising information about the location of each touch-sensitive pushbutton and about the size of the touch sensor in the detection area, are specified in the control unit. Dynamic touch-sensitive pushbuttons can be specified for the active areas of the display elements, which active areas can be used by elevator passengers only in a certain operating mode, whereas the position of the touch-sensitive pushbuttons specified for the passive areas is fixed. The control unit performs the necessary conversions of the coordinates between the active areas and the detection area of the touch sensor for fitting the touchsensitive pushbuttons and the place of the graphical patterns presenting them to each other.

The signal bus of the touch sensor is marked in FIG. 1 with the reference number 14, which signal bus is connected to the control unit 13 and on the basis of which the control unit receives information about a point that an elevator passenger touches on the call panel at any given time. Since the control unit 11 contains information about the location of each touch-sensitive pushbutton, it can deduce which touchsensitive pushbutton a passenger presses at any given time and react to the pressing in the manner required by the function connected to the 5 touch-sensitive pushbutton. For example, after an elevator passenger has pressed some floor pushbutton in the call panel, the control unit identifies which floor pushbutton was pressed and transmits this information to the elevator 10 or to the elevator system as a control command, which drives the elevator to the floor according to the call.

The control unit 13 is further arranged to monitor the components of the call panel, e.g. the operation of the display elements and of the touch sensor, and to form fault data if it detects a defect in a component being monitored. On the basis of the fault data the control unit changes its operating mode so that the detected fault does not prevent use of at least the most important functions of the call panel. If, for example, one of the display elements fails, the control unit changes its operating mode so that at least some of the information presented by the ailed display element and/or some of the touch-sensitive pushbuttons of display element are transferred to a display element that is functioning. Correspondingly, if a defect (does not detect a touch) of a touch sensor is detected in a certain detection area, the control unit can transfer the touch-sensitive pushbuttons in the area in question to a functioning part of the touch sensor. Since not all fault situations can be automatically detected, the aforementioned fault data can be transmitted to the control unit also from a remote service center and/or entered directly into the call panel locally. The function described above allows the elevator to be used also in fault situations for passenger transport and enables corrective servicing of the fault to be arranged for a time when servicing procedures cause the least nuisance possible.

The control unit 13 comprises an interface 13*a*, via which the call panel is in connection with devices and systems 17 external to the call panel. For example, status data and control commands between the elevator control or the group control of the elevator group are transmitted via the interface. Other information can also be conveyed to the call panel via the interface, such as e.g. the aforementioned fault information, information related to advertisements or news, information related to exceptional circumstances in the building, etc. Data transfer 18 via the interface 13*a* can be based on a conventional cable connection and/or a wireless communications connection.

Official regulations in many countries stipulate that identifiers for visually impaired people must be arranged in elevators, by means of which identifiers visually impaired passengers can use the elevator. For this purpose embossing is arranged on the front surface of the front plate of the call panel in connection with certain touch-sensitive pushbuttons, on the basis of which embossing a visually impaired person can identify with his/her fingertips each touch-sensitive pushbutton and the function connected to it. The embossing can be implemented e.g. by gluing an embossed sticker on top of a touch-sensitive pushbutton or immediately next to it. Embossing can be also made on the front surface of the front plate by machining, if the material of the front plate is suited to this purpose. Braille, for example, can be used as embossing. In one embodiment of the invention embossing is manufactured from a standard tape-type sticker, from which a group comprising a number of embossed pushbuttons suited to a number of usage sites is obtained by suitably cutting. The part of the tape-like standard sticker to be cut off is selected e.g. on the basis of which floors the elevator will serve in the building. The standard tape-type sticker can be manufactured from plastic or metal, which comprises a suitable adhesive surface for fixing to the front plate of the call panel, in which case fixing of the embossed pushbuttons is easy to perform e.g. in an installation site of an elevator. Since the location of embossed pushbuttons cannot be dynamically changed, they are preferably fixed in the passive area of the call panel. FIG. 4 illustrates the fixing of a pushbutton group 41 formed by a standard tape-type sticker next to the frame 34 of the front plate 33. The first three pushbuttons 41*a* of the pushbutton group 41 are presented magnified, for illustrative reasons. Owing to its placement a visually impaired elevator passenger easily finds the pushbutton group 41 by feeling the frame of the call panel and, after finding the pushbutton group 41, the correct pushbutton on the basis the embossing of the pushbutton group. A touch-sensitive pushbutton is specified next to each embossed pushbutton of a pushbutton group, by touching which touch-sensitive pushbutton a visually impaired elevator passenger can give e.g. a call to the floor to which he/she is traveling.

Auditive signals and/or signals based on vibration of the front surface of the front plate can be given for visually impaired people with signaling means 16 (FIG. 1). Signaling is formed e.g. from sequences of pulses, into which information is coded that indicates to a visually impaired person the function connected to the touch-sensitive pushbutton before pressing the touch-sensitive pushbutton (so-called advance signaling) and also the response connected to pressing a touch-sensitive pushbutton (so-called activation signaling). In addition to advance signaling and activation signaling, signaling that indicates the presence to a visually impaired person of a nearby touch-sensitive pushbutton, so-called proximity signaling, can be generated. FIG. 5 presents a schematic drawing of proximity signaling. When the finger of a visually impaired person is at a point on the surface of the front plate of a call panel, in the proximity of which point there is not a touch-sensitive pushbutton, proximity signaling is not generated (in FIG. 5, the point marked with the reference letter D). When a visually impaired person moves his/her finger towards a touch-sensitive pushbutton (FIG. 5, touch-sensitive pushbutton marked with reference mark B), proximity signaling is generated when the finger is sufficiently close to the touch-sensitive pushbutton B (FIG. 5, points marked with reference letter A). Proximity signaling is e.g. strong vibration, on the basis of which a visually impaired person knows that near the point of touch is a touch-sensitive pushbutton and, that being the case, can move his/her finger to the touch-sensitive pushbutton B and press the touch-sensitive pushbutton B (presented in FIG. 5 with the reference letter C). Close range is e.g. 0-10 mm as measured from the edge of the touch-sensitive pushbutton, but it can be greater or smaller than this, depending on the implementation. The curve E of FIG. 5 presents the magnitude of the strength (amplitude) of the signaling as a function of the distance of the point of touch D from the touch-sensitive pushbutton B. By using the signals described, embossed pushbuttons are not necessarily needed on the front plate, in which case the front plate of the call panel can be made totally smooth, easy to care for, robust and neat in appearance.

FIG. 2 presents a simplified front view of one call panel according to the invention. The frames 22 of the display elements 10 are marked in FIG. 2 with dashed lines, inside which remain the active areas 23 of the display elements. The object marked with reference number 20 is the front plate. The dashed line marked with the reference number 21 in FIG. 2 describes the detection area covered by the touch sensor, the area remaining inside which, excluding the active areas 23, covers a part of the passive area of the call panel. Three touch-sensitive pushbuttons 25 are specified for the active areas 23 of the call panel and two touch-sensitive pushbuttons 24, which are e.g. the door-open and door-close pushbuttons, in the passive area. The touch-sensitive pushbuttons 24 in the passive area can also be next to the display elements, near the edge of the active areas, in which case the text indicating the pushbutton, or other corresponding pushbutton information, can be presented in a corresponding point in a display element. The touch-sensitive pushbuttons 24 in the passive area can also be in the area remaining between two display elements, in which case the text indicating the pushbutton, or other corresponding pushbutton information, can be presented in a corresponding point in either display element.

FIG. 3*a* presents one assembly of a call panel according to the invention as an explosion drawing. The frame in FIG. 3*a* is marked with the reference number 34, which frame borders the call panel and inside which frame is installed a front plate 33, a support plate 32 and also a touch sensor 32 between these. The support plate 31 is a transparent plate, which presses against the rear surface of the front plate 34 of the touch sensor 32. The support plate comprises an aperture 35, via which the cabling of the touch sensor is taken to the rear of the support plate. Owing to its construction, the front plate is easily replaceable if, for example, it becomes scratched in use or it is desired to change the appearance of the front plate to another appearance. The display elements (FIG. 3*b*) are disposed behind the support plate 31 and are fixed to the frame 34 using suitable fixing elements. The construction enables variation in the number of display elements without changing the construction of the call panel. FIG. 3*b* presents a partly simplified oblique rear view of a call panel according to FIG. 3*a* when three display elements 36*a*, 36*b*, 36*c* are installed in the call panel. The assembled call panel can be fixed to the wall of an elevator car as a car call panel or to the wall on a floor level as a destination call panel. A call panel for a floor level can also be a call panel that is detached from the wall surface, which call panel is fixed to the floor of the floor level, beside the route of elevator passengers, using a suitable footing The invention is not limited solely to the embodiments described above, but instead many variations are possible within the scope of the inventive concept defined by the claims below. Thus, for example, the control unit can be formed of a number of different modules, of which one or more can be integrated into the structures of the call panel. Alongside a capacitive touch sensor, many other touch sensors suited to the purpose are possible, such as e.g. resistive touch sensors, touch sensors based on IR (Infra Red) technology, touch sensors based on SAW (Surface Acoustic Wave) technology, touch sensors based on APR (Acoustic Pulse Recognition) technology, touch sensors based on DST (Dispersive Signal Technology) technology, and touch sensors based on loadcells. Alongside TFT-LCD display elements many other display elements suited to the purpose are also possible, such as e.g. display elements based on OLED technology. Also display elements based on pico projectors, with which graphics can be projected from a short range onto a display surface (in the active area) from behind the display surface, are possible display elements in a call panel according to the invention.

The invention claimed is:

1. Call panel of an elevator or of an elevator system, the call panel comprising:

one or more display elements, a front plate covering the call panel, in connection with which a touch sensor is fitted, a control unit, to which said one or more display elements and the touch sensor are connected, where the detection area of the touch sensor covers both an active area, and a passive area, where the active area additionally utilizes said one or more display elements, while the passive area lacks display capability and remains outside at least some of the aforementioned active area, and in which one or more touch-sensitive pushbuttons are disposed in the passive area, and where the control unit is configured to react to a touch of the touch-sensitive pushbuttons.

2. Call panel according to claim 1, where the call panel comprises two or more display elements are installed in a vertical attitude into the call panel so that the shorter sides of the display elements are in a horizontal direction and are adjacent with respect to each other.

3. Call panel according to claim 1 or 2, where the control unit comprises an interface for conveying at least one of: control commands, status data, and other information between the control unit and devices or systems external to the control unit.

4. Call panel according to claim 1, where the call panel is designed such that the amount of display elements can be varied without changing the construction of the call panel.

5. Call panel according to claim 1, where the front plate is partly translucent such that light produced by the display elements is visible on a front surface of the front plate while the features of the display elements and other components and structures that are behind the front plate are not visible on the front surface of the front plate.

6. Call panel according to claim 1, where at least one touch-sensitive pushbutton in the passive area is a standard pushbutton of the elevator or of the elevator system.

7. Call panel according to claim 1, where the touch sensor is a film-type touch sensor fitted to a rear surface of the front plate.

8. Call panel according to claim 1, where at least one embossed pushbutton is arranged for visually impaired elevator passengers on a front surface of the front plate in connection with a touch-sensitive pushbutton.

9. Call panel according to claim 1, where a group of two or more embossed pushbuttons is made by cutting off a part of a tape-type standard preform based on an installation site of the elevator or elevator system.

10. Call panel according to claim 1, where the control unit changes its operating mode based on fault data connected to the control unit.

11. Call panel according claim 2, where the call panel is designed such that the amount of display elements can be varied without changing the construction of the call panel.

12. Call panel according claim 3, where the call panel is designed such that the amount of display elements can be varied without changing the construction of the call panel.

13. Call panel according to claim 2, where the front plate is partly translucent such that light produced by the display elements is visible on a front surface of the front plate while the features of the display elements and other components and structures that are behind the front plate are not visible on the front surface of the front plate.

14. Call panel according to claim 3, where the front plate is partly translucent such that light produced by the display elements is visible on a front surface of the front plate while the features of the display elements and other components and structures that are behind the front plate are not visible on the front surface of the front plate.

15. Call panel according to claim 4, where the front plate is partly translucent such that light produced by the display elements is visible on a front surface of the front plate while the features of the display elements and other components and structures that are behind the front plate are not visible on the front surface of the front plate.

16. Call panel according to claim 2, where at least one touch-sensitive pushbutton in the passive area is a standard pushbutton of the elevator or of the elevator system.

17. Call panel according to claim 4, where at least one touch-sensitive pushbutton in the passive area is a standard pushbutton of the elevator or of the elevator system.

* * * * *

UNITED STATES PATENT AND TRADEMARK OFFICE

CERTIFICATE OF CORRECTION

PATENT NO. : 8,336,678 B2
APPLICATION NO. : 13/179740
DATED : December 25, 2012
INVENTOR(S) : Vesa Poutiainen et al.

It is certified that error appears in the above-identified patent and that said Letters Patent is hereby corrected as shown below:

ON THE TITLE PAGE:

Insert the following:

-- (30) Foreign Application Priority Data

Feb. 16, 2009 (FI) ..... 20090054 --.

Signed and Sealed this
Sixteenth Day of April, 2013

Teresa Stanek Rea
*Acting Director of the United States Patent and Trademark Office*